United States Patent [19]

Jacoby

[11] 4,052,690

[45] Oct. 4, 1977

[54] SENSITIVE FUSE FOR FIRE ALARM

[75] Inventor: Sidney Jacoby, Philadelphia, Pa.

[73] Assignee: Evergard Fire Alarm Company, Inc., Philadelphia, Pa.

[21] Appl. No.: 647,330

[22] Filed: Jan. 8, 1976

[51] Int. Cl.[2] ..... H01H 37/76

[52] U.S. Cl. ..... 337/405; 337/403

[58] Field of Search ..... 337/405, 168, 404, 403, 337/402, 401, 406, 407, 416, 417; 116/106, 114.5, 114 Y, 114 Z; 169/23, 42; 340/237 S

[56] References Cited

U.S. PATENT DOCUMENTS

| | | | |
|---|---|---|---|
| 1,663,333 | 3/1928 | Carmean | 337/404 |
| 1,894,746 | 1/1933 | Johnson | 337/404 |
| 2,740,369 | 4/1956 | Thayer | 116/106 |

*Primary Examiner*—Harold Broome

*Attorney, Agent, or Firm*—Weiser, Stapler & Spivak

[57] ABSTRACT

A sensitive fuse for fire alarms comprising an extremely thin heat collector disk of nickel or brass nickel plated material. A pair of phenolic resin copper laminated attachment strips are soldered to the disk to form a unitary fuse. One attachment strip is permanently soldered to the disk and the other strip is attached to the disk with a eutectic solder which is formulated to melt at a low, predetermined temperature. The phenolic resin end of each strip has a punched hole for attaching the fuse assembly to alarm valve lever arms. The thinness of the heat collector disk results in rapid transfer of heat to melt the eutectic solder. The phenolic portions of the attachment strips serve to insulate the heat sensitive portions of the fuse assembly from the remainder of the alarm device to increase sensitivity.

11 Claims, 3 Drawing Figures

SENSITIVE FUSE FOR FIRE ALARM

BACKGROUND OF THE INVENTION

The present invention relates generally to the field of fire alarm systems, and more particularly, is directed to a super sensitive fuse assembly for alarm devices.

Fire alarm systems as presently designed most frequently are responsive to the presence of heat and may be designed with either a fixed temperature response or with a rate of rise temperature response. The present invention is directed to that type alarm having components responsive to the presence of a fixed elevated temperature, for example, 165° F., 136° F., or other standard temperature setting.

Traditionally, alarm response to a predetermined elevated temperature has been accomplished by fusing a low melting temperature alloy such as eutectic solder to function either an electrical alarm circuit or a mechanical alarm circuit for alarm sounding purposes. One such device is disclosed in my co-pending application Ser. No. 478,928, filed June 13, 1974 now U.S. Pat. No. 3,938,115, entitled "Combination Smoke and Heat Detector Alarm" wherein a fusible eutectic compound has been shown positioned as an obstruction within a gas conduit between the compressed gas tank and the alarm sounding horn. Upon melting of the eutectic compound by elevated temperature in the vicinity of the device, the gas conduit obstruction is cleared and the alarm sounding apparatus is actuated.

It is the common practice to rate alarm devices by applying certain standard tests such as those designed and conducted by Underwriters' Laboratories, Inc. In this manner, designers, architects, engineers and fire protection specialists can design workable fire alarm installations with a reasonable degree of accuracy. By applying such standard tests, alarm sounding devices have been rated and standards of installation have been established to enable architects, fire safety engineers, safety specialists and others to design and install alarm systems within buildings in an orderly manner and in accordance with predetermined standards.

Alarm equipment of the type set forth has usually been rated by Underwriters' Laboratories, Inc. and others for a 25 foot space rating between detectors. That is, one such heat detection unit must be installed for every 625 square feet of floor area or as otherwise stated, the heat detection units should be installed with no more than 25 foot spacing between adjacent units. Previous detector designers in the field have been generally unsuccessful in developing heat detection systems responsive to a fixed an elevated temperature that were sensitive enough to be approved for installation at spacings greater than 30 feet.

SUMMARY OF THE INVENTION

The present invention relates to heat detection alarm systems in general and more particularly, is directed to a fuse assembly suitable for use with alarm devices having sensitivity greater than heretofore possible with prior art devices.

The present invention relates to a super-sensitive fuse which is particularly adaptable for use with fire alarm systems both of the mechanical and electrical type which has been listed by Underwriters' Laboratories, Inc. for a 50 foot space rating between detectors.

The sensitive fuse of the present invention comprises an extremely thin heat collector disk fabricated of a metal, preferably nickel or brass nickel plated alloy. A pair of diametrically aligned, copper or brass attachment strips are endwardly laminated to phenolic plastic connectors for attachment to the alarm device. One of the copper or brass attachment strips is soldered to the disk with conventional 50—50 solder. The other strip is attached to the disk with a eutectic solder which is preferably formulated to melt at a predetermined low temperature, for example, 136° F.

The phenolic plastic end of each attaching strip has a punched hole to provide a means to fasten the fuse assembly to the valve lever arms when setting or arming the alarm device. The thinness of the heat collector disk acts to produce an extremely rapid heat pick up and its quick transfer to the eutectic solder which is the releasing mechanism. Due to the thin metal disk, the fuse assembly is extremly sensitive to the presence of heat and is capable of rapid, dependable operation.

The extreme sensitivity of the valve assembly is the direct result of two separate design features which cooperate to produce a very simple, extremely sensitive fuse device. Specifically, the thin disk itself, when exposed exteriorly of the alarm device results in rapid sensing of any heat buildup which may be within the vicinity of the alarm device. This heat is rapidly transmitted across the disk metal to the eutectic solder which then melts to release a copper or bronze strip for valve release purposes. The second novel feature of the assembly is th phenolic plastic portions of the attaching strips which serve as insulators between the disk itself and the remainder of the alarm device. The phenolic portions insulate the heat gathered by the disk from the alarm device in such a manner that all said heat which is collected is transmitted directly to the eutectic solder and not to other portions of the alarm device.

It is therefore an object of the present invention to provide an improved sensitive fuse for a fire alarm device of th type set forth.

It is another object of the present invention to provide a novel super-sensitive fuse for a fire alarm device which comprises an extremely thin disk of nickel or brass nickel plated alloy.

It is another object of the present invention to provide a novel sensitive fuse comprising an extremely thin nickel or brass nickel plated disk having attachment strips soldered thereto wherein one strip is soldered with conventional 50—50 solder and the other strip is attached with a eutectic solder.

It is another object of the present invention to provide a novel, super-sensitive fuse for a fire alarm device wherein the fuse elements comprise a thin metallic disk and attachment strips connected to the disk, the fuse assembly further including means to insulate the fuse assembly from the remainder of the fire alarm device.

It is another object of the present invention to provide a novel, super-sensitive fuse for a fire alarm device including disk means, attachment strip means soldered to the disk means, insulating means laminated to the attachment strip means and connection means between the disk means and at least one attachment strip means capable of adding tensile strength to the assembly.

It is another object of the present invention to provide a novel super-sensitive fuse assembly for a fire alarm device that is inexpensive in manufacture, simple in design and trouble free when in use.

Other objects and a fuller understanding of the invention will be had by referring to the following description and claims of a preferred embodiment thereof, taken in conjunction with the accompanying drawings, wherein like reference characters refer to similar parts throughout the several views and in which:

DESCRIPTION OF THE PREFERRED EMBODIMENT OF THE INVENTION

Figure 3:
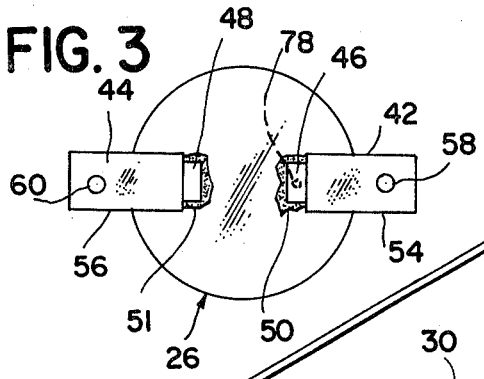
FIG. 3 is a top plan view on a reduced scale of the valve assembly in assembled relationship.

Although specific terms are used in the following description for the sake of clarity, these terms are intended to refer only to the particular structure of my invention selected for illustration in the drawings and are not intended to define or limit the scope of the invention.

Figure 1:
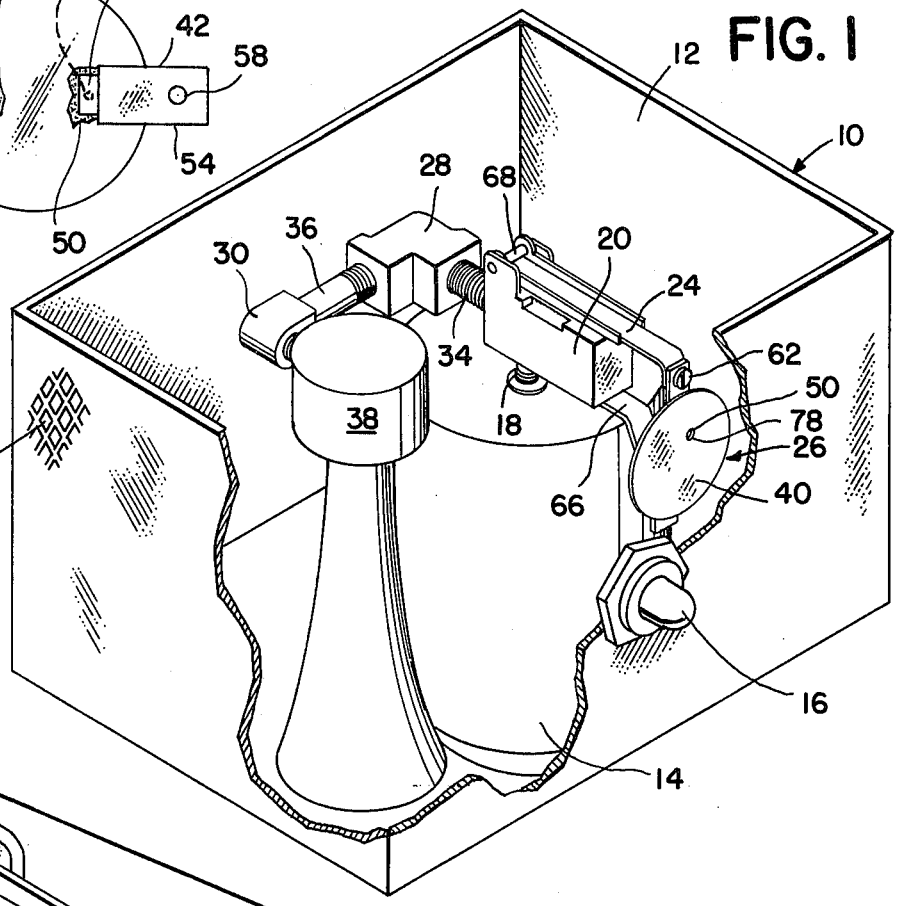
FIG. 1 is a perspective view of a fire alarm device, partially broken away, showing the fuse assembly of the present invention in use.

Referring now to the drawings, I show in FIG. 1 a self-contained type of mechanical fire alarm system generally designated 10 which includes an outer casing or housing 12. Mounted within the housing 12 is a compressed gas tank 14 which contains a quantity of easily compressible gas which may be Freon. In accordance with usual practice, the compressed gas tank 14 may be provided with a gas level indicator 16 of known design which extends exteriorly of the housing side wall 12 to permit easy visual indication of the gas level condition within the tank 14.

A threaded fitting 18 forms a hollow conduit between the tank 14 and the gas control valve 20. The valve 20 is normally closed to retain the compressed gas within the tank interior under all conditions except when the presence of a predetermined elevated temperature is noted. The valve 20 includes an operating lever 24 which is normally retained in its closed position as illustrated by the fuse assembly 26. Upon sensing the presence of the predetermined elevated temperature, the fuse assembly 26 releases the operating lever 24 which in turn opens the gas conduit to permit gas from within the interior of the compressed gas tank 14 to flow through the interior of the valve 20 through the hollow fittings 28, 30 and the conduit connectors 34,36 to reach the horn 38. The horn 38 then sounds the alarm in well known manner for the entire period of time when the compressed gas (not shown) flows through the valve and conduit system from the tank 14 to the horn 38.

Figure 2:
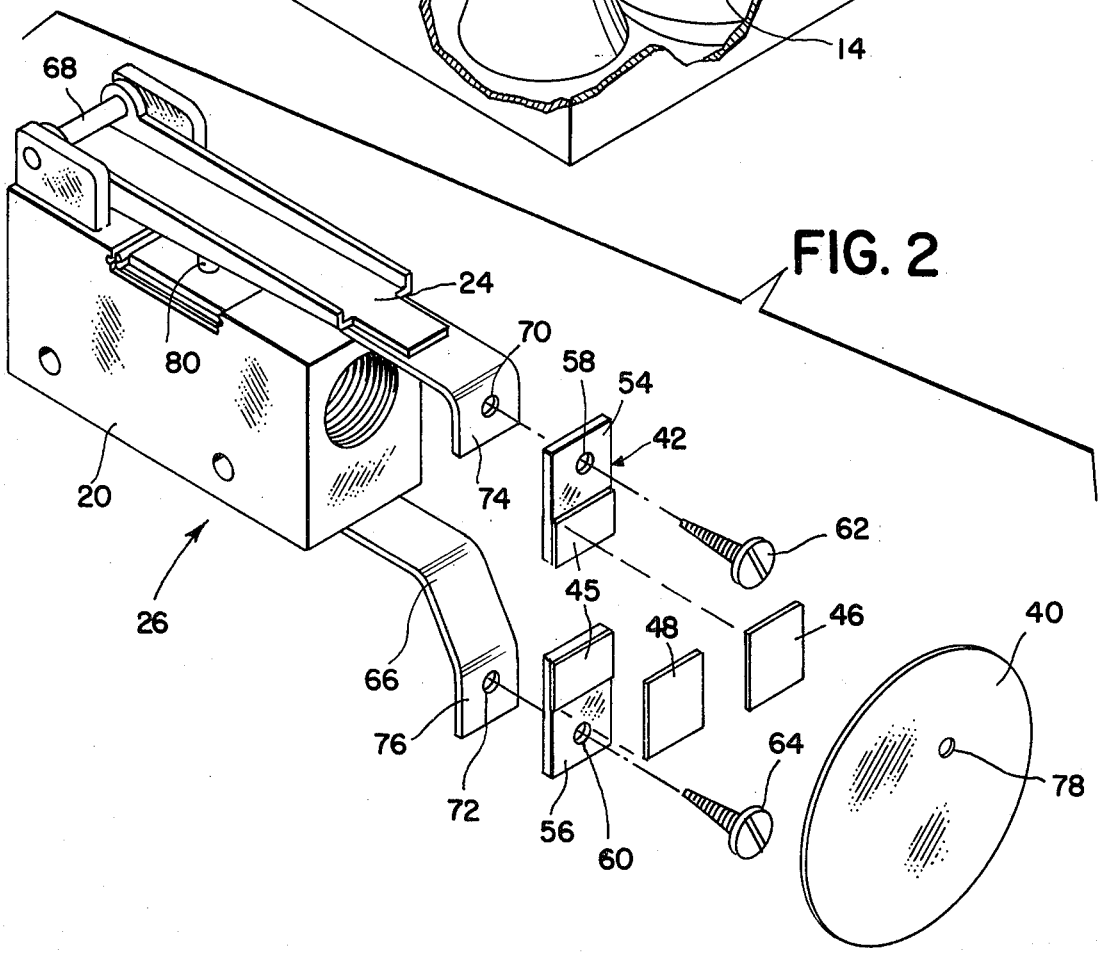
FIG. 2 is an enlarged, exploded, perspective view of the fuse assembly and the valve responsive to the fuse assembly.

Referring now to FIGS. 2 and 3, the valve assembly 26 is illustrated comprising an extremely thin disk or plate 40 which is manufactured on the order 0.002 inches in thickness. The disk 40 preferably is fabricated of thin nickel or brass, nickel plated material in the interest of being extremely sensitive to the presence of heat and to the rapid transmission of any heat thus collected. Attachment strip means 42, 44 are soldered or otherwise affixed to the think disk 40 in a secure manner, preferably in diametrical alignment. The attachment strip means 42, 44 each include a copper or brass mesh strip 46, 48 which can readily be secured to the disk 40 in a strong connection by utilizing solder. Preferably, a copper base 45 is laminated to the insulators 54, 56 to provide a secure base for the solder 50, 51. As illustrated in FIG. 3, one strip 46 is secured to the disk 40 by utilizing a eutectic solder 50 of known composition, such as a eutectic solder formulated to melt at a low, predetermined temperature, for example, 136° F. The other copper or brass connector strip 48 is soldered to the heat collector disk in conventional manner such as by using a usual 50—50 solder 51. Thus, upon detecting sufficient heat of a predetermined elevated temperature, the connection between the heat collector disk 40 and the copper attaching strip 46 will separate upon the fusing of the eutectic solder connection 50.

Each of the copper or brass mesh attaching strips 46, 48 is endwardly secured to an insulating connector 54, 56 at the laminated base 45 thereof. The insulating connectors are preferably fabricated of a phenolic plastic. Each of the plastic insulators 54, 56 is drilled or otherwise provided with an attaching opening 58, 60 through which the connector screws 62,64 are turned.

Referring now to FIGS. 1 and 2, the gas control valve 20 is illustrated as including a fixed lower arm 66 and an operating lever arm 24 which is upwardly pivotal about the pivot pin 68. The valve operating lever arm 24 turns downwardly at 90° to form a flat face 74 through which an opening 70 is provided. Similarly the fixed arm 66 is bent downwardly at ninety degrees to provide a flat face 76 which is drilled or otherwise provided with an opening 72. Preferably, the faces 74, 76 of the arms 24, 66 align in the same vertical plane, although this is not necessarily a prerequisite to satisfactory operation. As illustrated in FIG. 1, the arms 24, 66 extend through the housing side wall 12 a sufficient distance to position the fuse assembly 26 exteriorly of the housing 12. By thus positioning the disk 40 exteriorly of the housing and insulating the disk 40 from the remainder of the device by employing the phenolic insulators 54, 56 an extremely sensitive fuse assembly can be provided and the operating capability of the alarm device 10 can be greatly enhanced.

As illustrated in FIGS. 1 and 3, the disk 40 is provided with connecting means comprising a small opening 78 which aligns with the copper strip 46. The prepunched hole 78 is filled and covered by the eutectic solder 50 when it is assembled to thereby add considerable tensile strength to the fuse assembly without in any manner reducing the sensitivity of the device or in any manner affecting the release time of the fuse assembly 26. The solder 50 within the hole 78 adds tensile strength to the connection between the copper strip 46 and the disk 40. It will be noted that the solder 50 flows into the hole and therefore the solder within the hole would have to be sheared from the remainder of the solder before the junction could fail upon the imposition of external forces which would tend to pull the strip 46 from the disk 40.

In operation, the fuse assembly 26 is exteriorly affixed to the valve 20 so that the disk 40 is positioned exteriorly of the alarm device housing 12. The attaching screws 62, 64 connect the valve fuse assembly 26 intermediate the lower fixed arm 66 and the operating lever arm 24 of the valve 20 to thereby normally continuously hold the valve lever arm 24 downwardly against the urging of the spring biased plunger 80. When increased temperature of the air surrounding the alarm device 10 is detected by the heat collector disk 40, the increase in temperature heats the eutectic solder 50 to its melting point. The copper attaching strip 46 is then released from its connection to the heat collecting disk 40. With the valve assembly thus released by the fusing of the solder 50, the operating lever is released to move upwardly and pivotally about the pivot pin 68 allowing the plunger 80 to move upwardly, thereby opening the valve 20. The cylinder or tank gas under pressure is thus released and flows through the hollow fitting 18, the valve 20 and the conduit system comprising the fittings 28, 30 and hollow conduit portions 34, 36 to energize the horn 38. The horn will then blow until the entire gas contents of the cylinder or tank 14 are released.

Although I have described the present invention with reference to the particular embodiments herein set forth, it is understood that the present disclosure has been made only by way of example and that numerous changes in the details of construction may be resorted to without departing from the spirit and scope of the invention. Thus, the scope of the invention should not be limited by the foregoing specification, but rather, only by the scope of the claims appended hereto.

I claim:

1. In a sensitive fuse for a heat responsive device, the combination of a thin metallic plate to collect heat from the environment;

an attachment strip removably connected to the plate said attachment strip comprising a non-ferrous metal strip and a non-metallic insulator laminated together; and fusible means responsive to heat to disconnect the attachment strip from the plate, said fusible means affixing the non-ferrous metal strip to the plate in the absence of heat.

2. The sensitive fuse of claim 2 further comprises a non-ferrous metal base interposed between the strip and the insulator.

3. The sensitive fuse of claim 1 wherein the plate is configured in the shape of an extremely thin, flat configuration.

4. The sensitive fuse of claim 3 wherein the plate is approximately 0.002 inches in thickness.

5. The sensitive fuse of claim 3 wherein the plate comprises at least a portion of nickel.

6. The sensitive fuse of claim 1 which comprises connection means to add tensile strength to the connection between the attachment strip and the metallic plate said connection means increasing resistance to shear.

7. The sensitive fuse of claim 6 wherein the connection means comprises an opening in the plate and wherein at least a portion of the fusible means enters the opening.

8. The sensitive fuse of claim 6 wherein a portion of the fusible means fills the said opening.

9. The sensitive fuse of claim 1 wherein the device is mounted within an enclosure and which comprises means to mount the sensitive fuse exteriorly of the enclosure, said means to mount comprising a pair of arms extending outwardly from the enclosure.

10. The sensitive fuse of claim 9 wherein the device comprises a gas valve, the said gas valve having a pivotal operating arm, a portion of said arm extending exteriorly from the enclosure to provide one attachment for an attaching strip.

11. The sensitive fuse of claim 10 wherein the other of said pair of arms is fixedly connected to the device and wherein a portion of said other arm extends exteriorly of the enclosure to provide an attachment for a second attaching strip whereby the plate is interconnected between the two attachments to restain pivotal movement of the pivotal arm.

* * * * *